United States Patent [19]

Everts

[11] Patent Number: 4,947,513

[45] Date of Patent: Aug. 14, 1990

[54] CONNECTOR FOR A CONVERTIBLE BLOWER-VACUUM

[76] Inventor: Robert G. Everts, 2050 N. 90th Pl., Chandler, Ariz. 85224

[21] Appl. No.: 174,552

[22] Filed: Mar. 29, 1988

[51] Int. Cl.[5] ..... A47L 5/14

[52] U.S. Cl. ..... 15/330; 15/344; 15/405

[58] Field of Search ..... 15/327 R, 327 D, 330, 15/344, 405

[56] References Cited

U.S. PATENT DOCUMENTS

| | | | |
|---|---|---|---|
| 3,618,157 | 11/1971 | Bassin | 15/330 |
| 3,775,951 | 12/1973 | Eichholz et al. | 15/327 D X |
| 4,325,163 | 4/1982 | Mattson et al. | 15/330 |
| 4,342,131 | 8/1982 | Reid | 15/327 D |
| 4,476,608 | 10/1984 | Rasmussen | 15/352 X |
| 4,674,146 | 6/1987 | Tuggle et al. | 15/330 |
| 4,694,528 | 9/1987 | Comer et al. | 15/344 X |
| 4,713,858 | 12/1987 | Kelber | 15/344 X |

*Primary Examiner*—Chris K. Moore

*Attorney, Agent, or Firm*—Donald D. Mon

[57] ABSTRACT

A hand-held implement selectively usuable as a blower or a vacuum. A power-driven impeller moves an air-stream through an impeller chamber from an intake port to an outlet port. A pair of coaxial rims surrounds the intake port to form a peripheral groove that can receive the end of a pipe and restrain it from lateral movement. An axial pull device can draw the pipe to hold it in the groove.

5 Claims, 2 Drawing Sheets

CONNECTOR FOR A CONVERTIBLE BLOWER-VACUUM

FIELD OF THE INVENTION

This invention relates to convertible vacuum-blower, and in particular to a reliable releasable connector for holding a pipe to the body of the implement.

BACKGROUND OF THE INVENTION

Hand held implements which are capable of functioning as a vacuum or as a blower are popularly used by gardeners and by outdoor maintenance personnel. They customarily include a fractional horsepower gasoline engine which turns an impeller. The impeller generates an air stream that is used for blowing or vacuuming purposes.

A blower pipe can be connected to the output port of the impeller to direct the air stream to blow leaves and debris in the blower mode, or a collection bag can be attached to it to receive detritus which is gathered in the vacuum mode.

In the blower mode, the intake port to the impeller is suitably shrouded to protect the operator. In the vacuum mode a large diameter, elongated vacuum pipe is connected to the intake port. Its free end is moved along the ground to pick up detritus. The flow direction of the air stream is the same in both modes of operation, but for each mode, different devices such as pipes or the collection bag are connected to the appropriate port, and they must resist the physical contacts to which they are subject.

Such an arrangement is shown in Tuggle patent No. 4,674,146, issued June 23, 1987, which patent is incorporated herein by reference to its showing of a hand held convertible vacuum/blower for these purposes. In the Tuggle device the connection is made by means of a collar which surrounds the port, and a clamp which surrounds the collar and compresses it against the pipe or against the neck of the bag to hold it in place. A vacuum/blower with this arrangement has in fact enjoyed wide sales acceptance. However, applicant has found that a peripheral clamp connection is more subject to unintentional disengagement than it should be. While no harm is done, it is an inconvenience to have to stop the implement and reassemble it.

It is an object of this invention to overcome this disadvantage of the peripheral clamp joinder. In so doing it has been kept in mind that this implement fits into an acoustic niche where costs and complexity must be minimized.

Accordingly it is another object of this invention to provide connector means which is expedient and economical, as well as more reliable.

BRIEF DESCRIPTION OF THE INVENTION

This invention is carried out with a convertible vacuum-blower which has a frame supporting a motive means such as a fractional horsepower gasoline engine, and an impeller driven by it and which has a body that forms an intake port and an outlet port on opposite sides of the impeller. Each port has a surrounding face against which a pipe is to be fitted.

According to the preferred embodiment of the invention, an axial-pull connector has two parts, one of which is attached to the body, and the other of which is attached to the pipe. These parts are adapted to be joined to each other, so as to exert an axial pull on the pipe and draw it toward and against the body in order to hold it firmly seated against the body, and more reliably resistant to side loads.

The preferred embodiment of the connector is a toggle linkage.

Another embodiment of the connector is a threaded stem and nut combination.

The above and other features of this invention will be fully understood from the following detailed description and the accompanying drawings, in which:

DETAILED DESCRIPTION OF THE INVENTION

Figure 1:
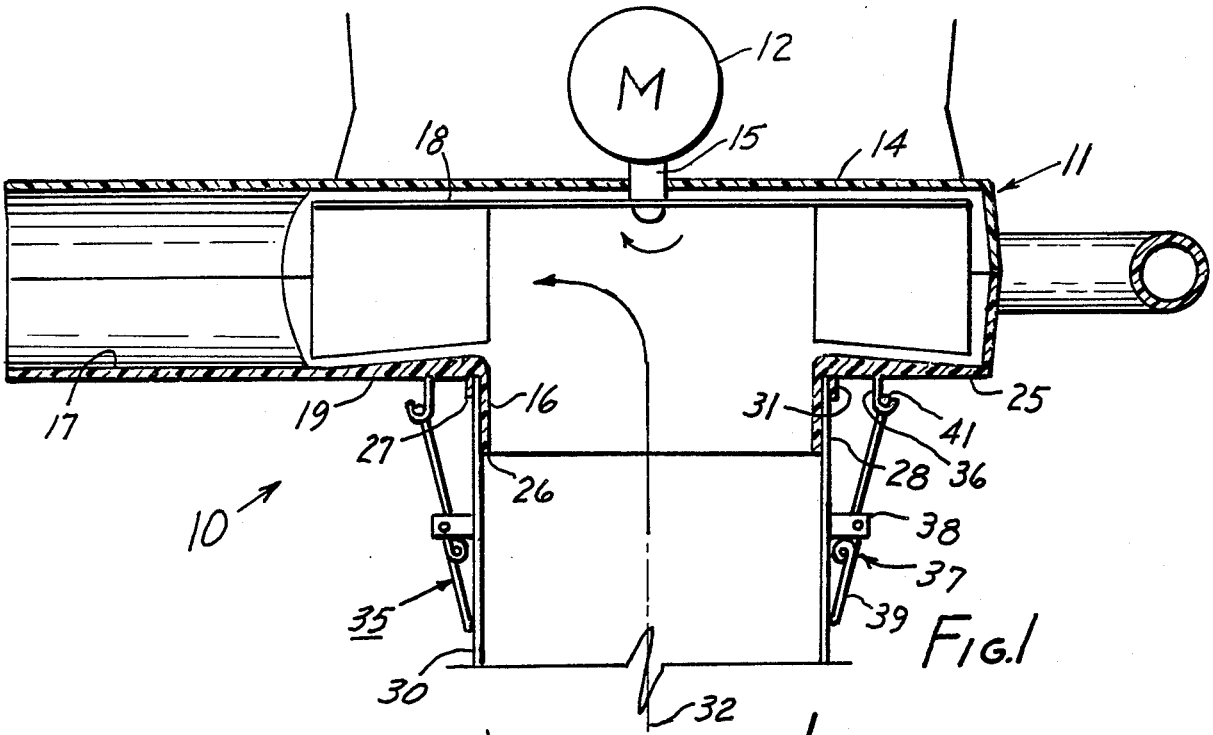
FIG. 1 is an axial cross section, partly in schematic notation, showing the presently preferred by preferred embodiment of the invention.
Figure 2:
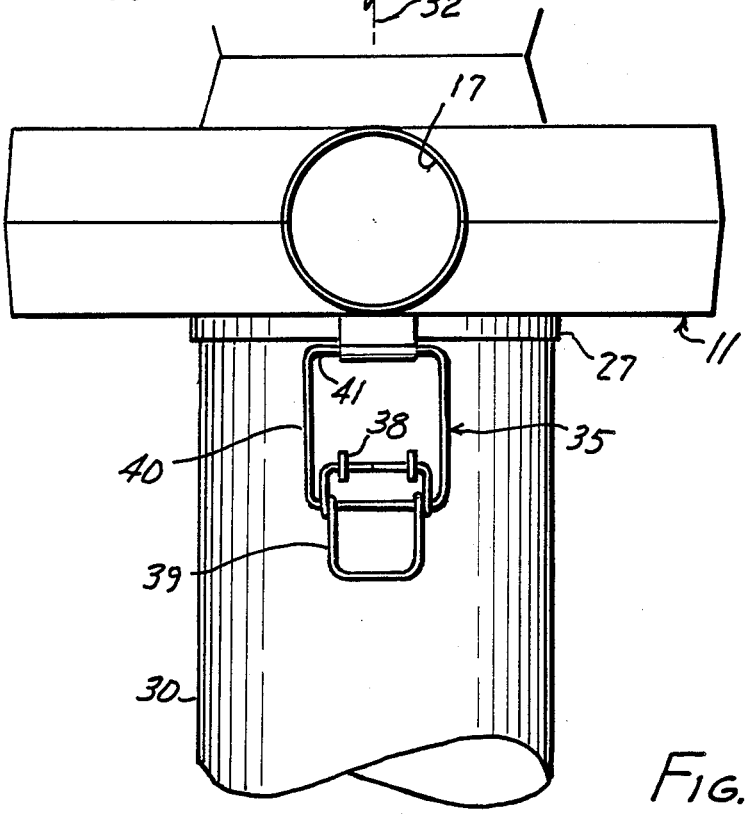
FIG. 2 is a side view of the FIG. 1.

FIG. 1 shows the general configuration of a blower-vacuum implement 10 which advantageously employs this invention. It has a body 11 which encloses and supports a motor means 12 such as a two cycle internal combustion gasoline engine.

An impeller 14 connected by a shaft 15 to the motor. It drives an air stream from intake port 16 to outlet port 17. A suitable shroud 18 forms an impeller chamber 19 into which the two ports open, and in which the impeller fits.

Intake port 16 is externally surrounded by a face 25 that faces outwardly. Face 25 includes two concentric rims 26,27 which are spaced apart to form a peripheral groove 28 in the face between them.

A vacuum pipe 30 is detachably connected to the body at face 25. It has a circular end 31 which snugly fits in groove 28 between the rims. The pipe has a central axis 32. As shown in the Tuggle patent, a cover can be removed from in front of the intake port to enable the pipe to be connected. In the blower mode where pipe 30 is not used, the cover is replaced. It provides a grill or a spacing to enable air to enter the inlet port in the blow mode when this pipe is removed.

Connector means 35 is provided releasably to hold vacuum pipe 30 against the face. It has a first part 36 which comprises a hook attached to the face. The second part 37 is a toggle having a pivot block 38 mounted to the pipe, a toggle lever 39 pivoted to the pivot block, and a catch member 40 pivotally mounted to the toggle lever at a point spaced from the block. This assembly will be recognized as a toggle latch of the type frequently used on trunks and storage chests. The latched position is shown. Turning toggle lever 39 by about 180 degrees will move cross bar 41 of the catch member far enough the clear the end of the hook to release the connector.

Additional similar connector means will also be provided around the intake port. Usually two of these will be enough, although more could be provided. This is a convenient and improved connector, and exerts an axial thrust to hold the pipe to the face. A sidewise blow on the pipe will not tend to release this engagement, and the engagement is a positive one that does not rely on a frictional grip.

Figure 3:
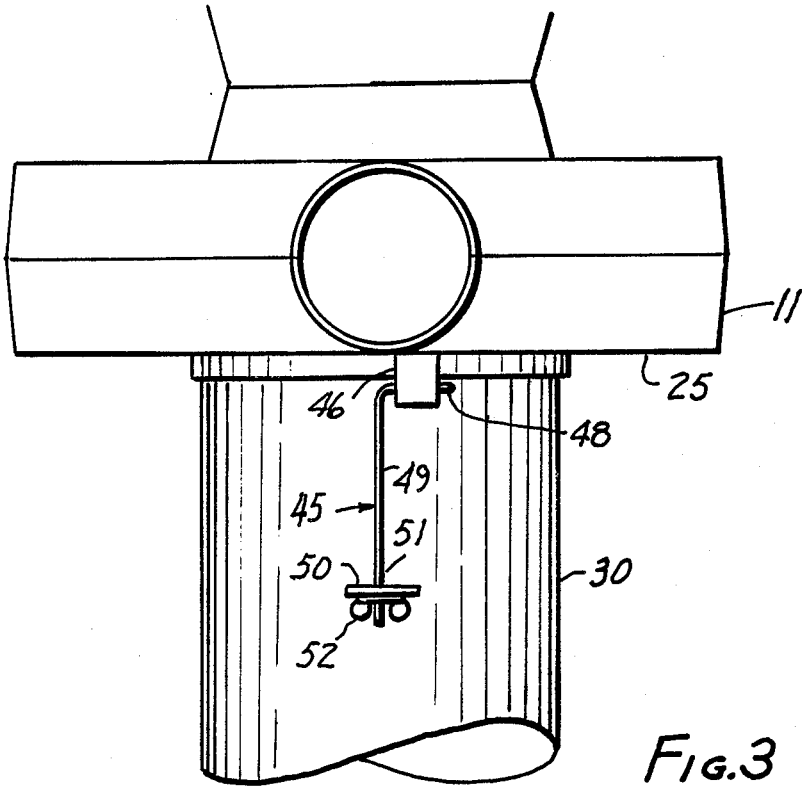
FIG. 3 is a fragmentary showing of another embodiment of the invention.
Figure 4:
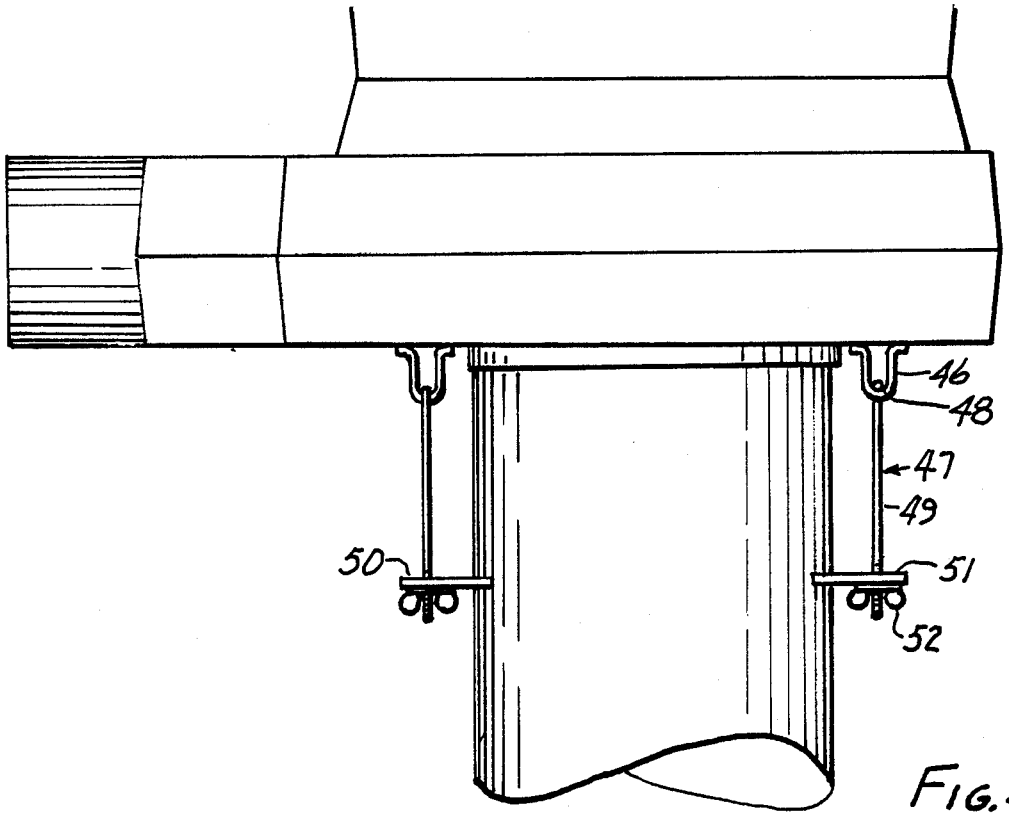
FIG. 4 is a side view of FIG. 3.

FIGS. 3 and 4 show another useful, but somewhat less convenient connector means 45 that can be directly substituted for connector means 35. One part of this connector means is a hinge socket 46 that is attached to face 25, and a latch pin 47 comprising a bent bar forming a hinge pin 48 and a threaded post 49. The other part is a bracket 50 on the pipe with a notch 51 that passes post 49. A wing nut 52 is threaded onto post 49 and bears against bracket 50 to exert an axial force to pull the pipe against the face.

To remove this pipe, the wing nut is unthreaded from the post. A plurality of these connectors will generally be provided.

In both embodiments of the invention, a part of the connector is attached to the body and the other part is attached to the pipe. Fastening and tightening the parts together holds the pipe to the body with an axial force.

Similar connectors can be provided at the outlet ports which are not illustrated in order to simplify the drawings. For example they can be used to connect a blower pipe, or a pipe which forms part of the neck of a connector bag, to the body at a face around an outlet port, just as is shown at the intake port.

This invention is not to be limited by the embodiments shown in the drawings and described in the description, which are given by way of example and not of limitation, but only in accordance with the scope of the appended claims.

I claim:

1. In a hand-held implement selectively provided for a blowing or a vacuuming operation, having a body housing, an impeller chamber having an intake port and an outlet port, a power driven impeller in said chamber for moving an airstream into said intake port, through said chamber and out through said outlet port, and a vacuum pipe to be removably connected to said body to conduct air from a free end of said vacuum pipe to an end thereof which surrounds said intake port, the improvement comprising:

a pair of coaxial rims on said body surrounding said intake port, having different diameters so as to form a peripheral groove between them so proportioned and arranged as to receive said free end of said pipe and restrain it from lateral movement;

axial-pull connector means comprising a first part connected to said body and a second part connected to said vacuum pipe, whereby drawing said parts together with said means draws said pipe axially toward and holds it against said body in said groove.

2. Apparatus according to claim 1 in which said connector means is a toggle linkage.

3. Apparatus according to claim 2 in which said toggle linkage includes a hook means and an anchor means, one of said hook means and anchor means being fixed to said body and the other being fixed to said vacuum pipe.

4. Apparatus according to claim 1 in which said connector means includes a threaded stem, a nut attachable to said stem, and a bracket, one of said stem and bracket being fixed to said vacuum pipe and the other to said body, whereby said nut can be threaded to said stem and tightened against said bracket to press said vacuum pipe against said body.

5. Apparatus according to claim 1 in which another pipe is provided to be attached at said outlet port, and another said connector means is provided to press it against said body.

* * * * *